United States Patent [19]

Mazurik et al.

[11] Patent Number: 4,908,928

[45] Date of Patent: Mar. 20, 1990

[54] SLUG RIVETING METHOD AND APPARATUS

[76] Inventors: Frank T. Mazurik, Rte. 3, Box 139, Hardin Hallow Rd., Watertown, Tenn. 37184; Mark J. Andrews, 190 59th St., Niagara Falls, N.Y. 14304; James L. Birke, 211 12th Ave., North Tonawanda, N.Y. 14120

[21] Appl. No.: 202,577

[22] Filed: Jun. 3, 1988

[51] Int. Cl.[4] ..... B23P 19/04; B27C 3/06

[52] U.S. Cl. ..... 29/525.1; 29/509; 29/243.54; 29/525.2; 408/25

[58] Field of Search ..... 29/243.54, 243.55, 34 B, 29/509, 525.1, 701, 709, 714, 715, 564, 564.1, 525.2; 408/1 R, 25, 31, 84

[56] References Cited

U.S. PATENT DOCUMENTS

| | | | |
|---|---|---|---|
| 3,557,442 | 1/1971 | Speller | 29/243.53 |
| 3,874,070 | 4/1975 | Falcionni | 29/526 |
| 4,192,058 | 3/1980 | Falcioni | 29/526 A |
| 4,493,141 | 1/1985 | Krezak | 29/509 |
| 4,515,302 | 5/1985 | Davern et al. | 29/243.54 |

OTHER PUBLICATIONS

Tom D. Stone, No Tack Assembling of Wing Skin and Spar Assemblies, SME Technical Paper #AD86-686, 1986, Society of Manufacturing Engineers.

*Primary Examiner*—Timothy V. Eley
*Assistant Examiner*—Peter Dungba Vo
*Attorney, Agent, or Firm*—Christel, Bean & Linihan

[57] ABSTRACT

A method and apparatus for riveting two workpieces (10, 12) together by simultaneously upsetting both ends of a slug rivet (R) while maintaining the outer surface (16) of one of the workpieces (10) in a substantially constant fixed work plane (20) during riveting. The workpieces are held between two clamps (18, 28), one of the clamps (18) establishing the fixed work plane. After drilling, a slug rivet is placed within the drilled hole, and then a first riveting ram (42) is moved to establish a desired die cavity. A second riveting ram (58) is then moved until it just contacts the rivet. The rams (42, 58) are then simultaneously moved towards each other at equal rates to simultaneously form upset heads on both ends of the rivet.

22 Claims, 3 Drawing Sheets

TABLE I

| STEP \ VALVE | 112 | 114 | 116 | 124 | 126 | 132 | 134 | 142 | 148 |
|---|---|---|---|---|---|---|---|---|---|
| 1 | A | A | A | A | B | B | A | A | A |
| 2 | A | A | A | B | A | B | A | A | A |
| 3 | A | A | A | A | B | B | A | A | A |
| 4 | A | A | A | A | B | B | A | A | A |
| 5 | A | A | A | A | B | C | B | A | A |
| 6 | A | A | A | A | B | B | A | A | A |
| 7 | B | A | A | A | B | B | A | A | A |
| 8 | B | A | A | A | B | A | A | B | A |
| 9 | B | A | A | B | A | A | A | B | A |
| 10 | B | A | A | B | B | B | A | A | A |
| 11 | B | A | A | B | B | B | B | A | A |
| 12 | A | A | C | B | B | B | B | A | A |
| 13 | A | A | B | B | B | B | B | A | A |
| 14 | A | A | A | A | B | B | A | A | A |
| 15 | A | A | A | A | C | B | A | A | B |
| 16 | A | A | A | A | B | B | A | A | A |
| 17 | A | A | A | A | B | A | A | B | A |
| 18 | A | A | A | A | B | B | A | A | A |
| 19 | A | A | A | A | B | B | A | A | A |
| 20 | A | A | A | A | C | B | A | A | B |
| 21 | A | B | A | A | B | B | A | A | A |

| | | |
|---|---|---|
| VALVES 124, 134 142 & 148 | POSITION | A – FLOW BLOCKED |
| | POSITION | B – FLOW THROUGH TO RESERVOIR |
| VALVE 112 | POSITION | A – RETRACT STOP |
| | POSITION | B – EXTEND STOP |
| VALVE 114 | POSITION | A – EXTEND CYLINDER |
| | POSITION | B – RETRACT CYLINDER |
| VALVE 126 | POSITION | A – RAISE PISTON |
| | POSITION | B – FLOW THROUGH VALVE BLOCKED |
| | POSITION | C – LOWER PISTON |
| VALVE 132 | POSITION | A – RAISE RAM |
| | POSITION | B – FLOW THROUGH VALVE BLOCKED |
| | POSITION | C – LOWER RAM |
| VALVE 116 | POSITION | A – DRAIN TO RESERVOIR |
| | POSITION | B – FLOW THROUGH VALVE BLOCKED |
| | POSITION | C – EXTEND MASTER CYLINDER |

SLUG RIVETING METHOD AND APPARATUS

TECHNICAL FIELD

The present inventon relates generally to a riveting method and apparatus and more particularly to a method and apparatus of riveting together two or more workpieces wherein both ends of a slug rivet are simultaneously upset during riveting, the outer surface of one of the workpieces being maintained in a substantially constant fixed work plane during riveting.

BACKGROUND OF THE INVENTION

In the aircraft industry the skin of an aircraft is traditionally riveted to frame members such as stringers or the like. Because of the large number of rivets utilized to produce a single aircraft, and also because of the requirements of virtually indefinite life of the rivets, much attention has been given in the industry to various methods and apparatus for riveting. One riveting method and apparatus which has been utilized by the industry for a number of years is shown in U.S. Pat. No. 3,557,442. This patent discloses the utilization of slug rivets to secure two members together, the workpieces which are to be joined together being initially clamped together. This patent teaches that the upper rivet forming anvil is initially extended to a full down locked position with all of the rivet upsetting force then being applied by upward movement of the lower rivet forming anvil, the ends of the rivet being simultaneously formed. Due to the sequential movement of the rams the surfaces of the workpieces will move relative to a fixed work plane. This is referred to in the industry as a "wink".

As the workpieces are winked or moved during the squeeze cycle of the foregoing process they will have a tendency to oscillate before returning to their original position. This oscillation could delay the next rivet forming operation or any other subsequent operation. Additionally, if the slug rivet can be formed without winking better control of the position of the slug can be achieved. As there would be no movement of the workpiece even greater uniformity of the bulging of the rivet may be achieved which is desirable for rivet fatigue life cycles. In addition, by not moving the workpieces during the riveting there is a potential for even faster rate times. In addition the workpieces can be rigidly fixtured thus eliminating the need for temporary fasteners that would have to be replaced.

DISCLOSURE OF THE INVENTION

Therefore, it is an object of the present invention to provide an antiwink slug riveting method and apparatus.

The foregoing is achieved by clamping the workpieces together with equal forces on each side of the workpieces, one surface of one of the workpieces lying in a substantially fixed work plane. After the workpieces are clamped together the workpieces are drilled to form aligned apertures therein and a slug rivet is positioned within the aligned apertures. Next, one of the riveting ram assemblies is disposed with respect to the slug rivet to form a predetermined die cavity. After this has been accomplished both ends of the slug rivet are contacted by moving the other ram towards that ram which establishes the fixed die cavity. Then, it is only necessary to move the rams together at equal rates and distances to upset the slug rivet. After the rivet has been formed and properly tempered by maintaining the rams together for a predetermined period of time it is only necessary to move the rams away from the upset slug rivet and to then unclamp the workpiece to complete the operation. Optionally the surface of one of the upset heads on the rivet may be milled to lie very close to the outer surface of the workpieces. An apparatus has been developed for carrying out the method described above and it has been found in test work that movement of the surface which lies in the substantially fixed work plane can be held to less than 0.005 of one inch.

The foregoing will be more fully understood after a consideration of the following detailed description taken in conjunction with the accompanying drawings.

DETAILED DESCRIPTION

Figure 1:
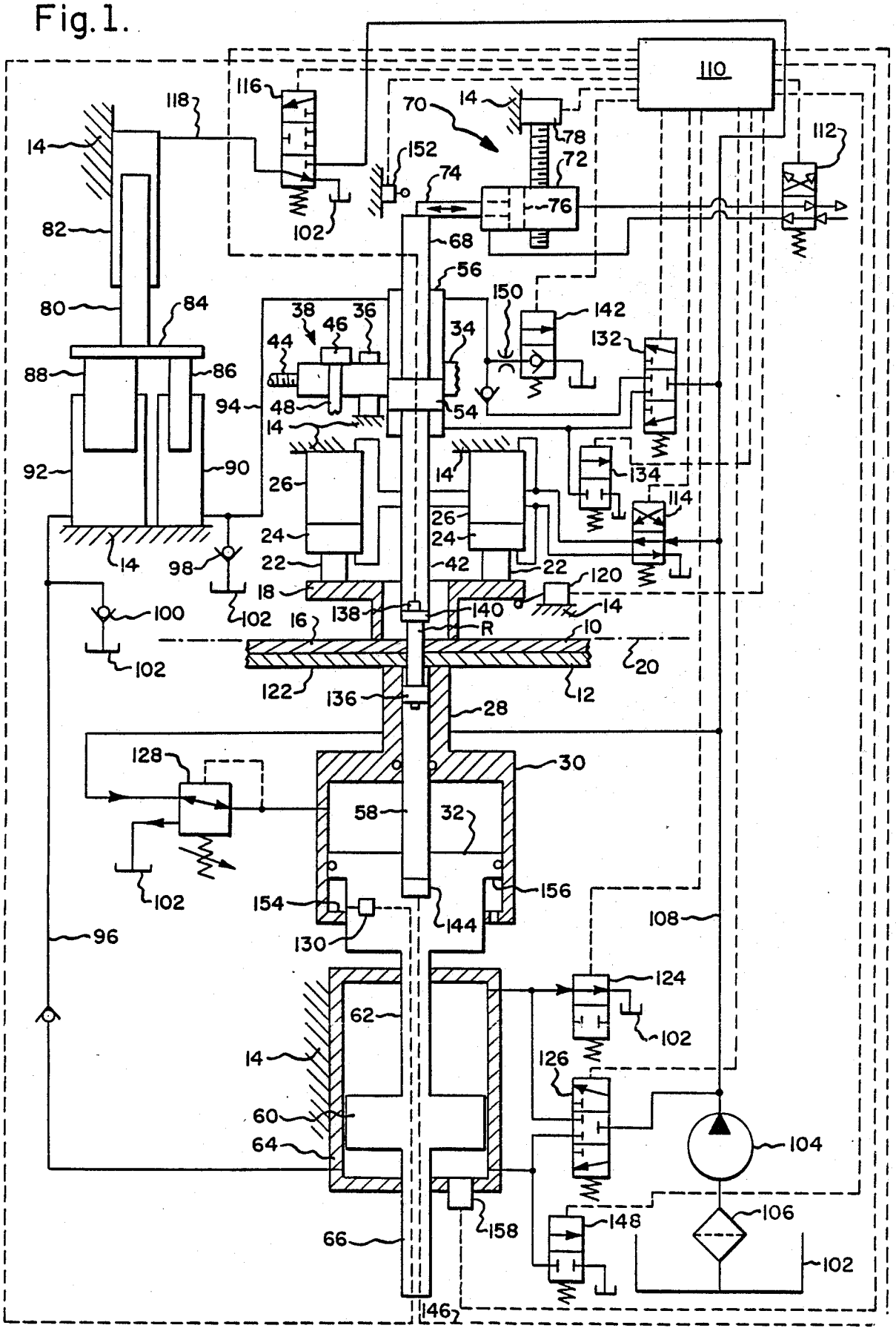
FIG. 1 is a schematic illustration of the apparatus of this invention.

Reference will be made initially to FIG. 1 in which the apparatus of this invention is illustrated. Two workpieces which are to be joined together are indicated at 10 and 12, respectively. While only two workpieces are illustrated in FIG. 1, it should be appreciated that more than two workpieces could be joined together by the method and apparatus of this invention. The apparatus includes a principal frame indicated schematically at 14. The frame and the workpieces can be moved relative to each other to establish the desired working positions, and when moved relative to each other the frame is so positioned with respect to one outer side 16 of one of the workpieces, namely workpiece 10, that when a first clamp means 18 carried by the apparatus is fully extended it will contact the one side 16 of one of the workpieces 10 so that the one side 16 will lie in a substantially fixed work plane indicated by the dot dash line 20. The first clamp means 18 is carried by piston rods 22 which are in turn connected to associated pistons 24 disposed within double acting first clamp cylinders 26 which are secured to the frame 14.

Mounted below the first clamp means on the opposite side of the workpieces 10, 12 is a second clamp means 28 in coaxial alignment with the first clamp means 18. The second clamp means is carried by a second clamp cylinder 30 which is in turn supported upon a second clamp piston 32, which is supported in the manner which will be brought out below.

Figures 2, 3, 4, 5, 6, 7, 8, 9, 10:
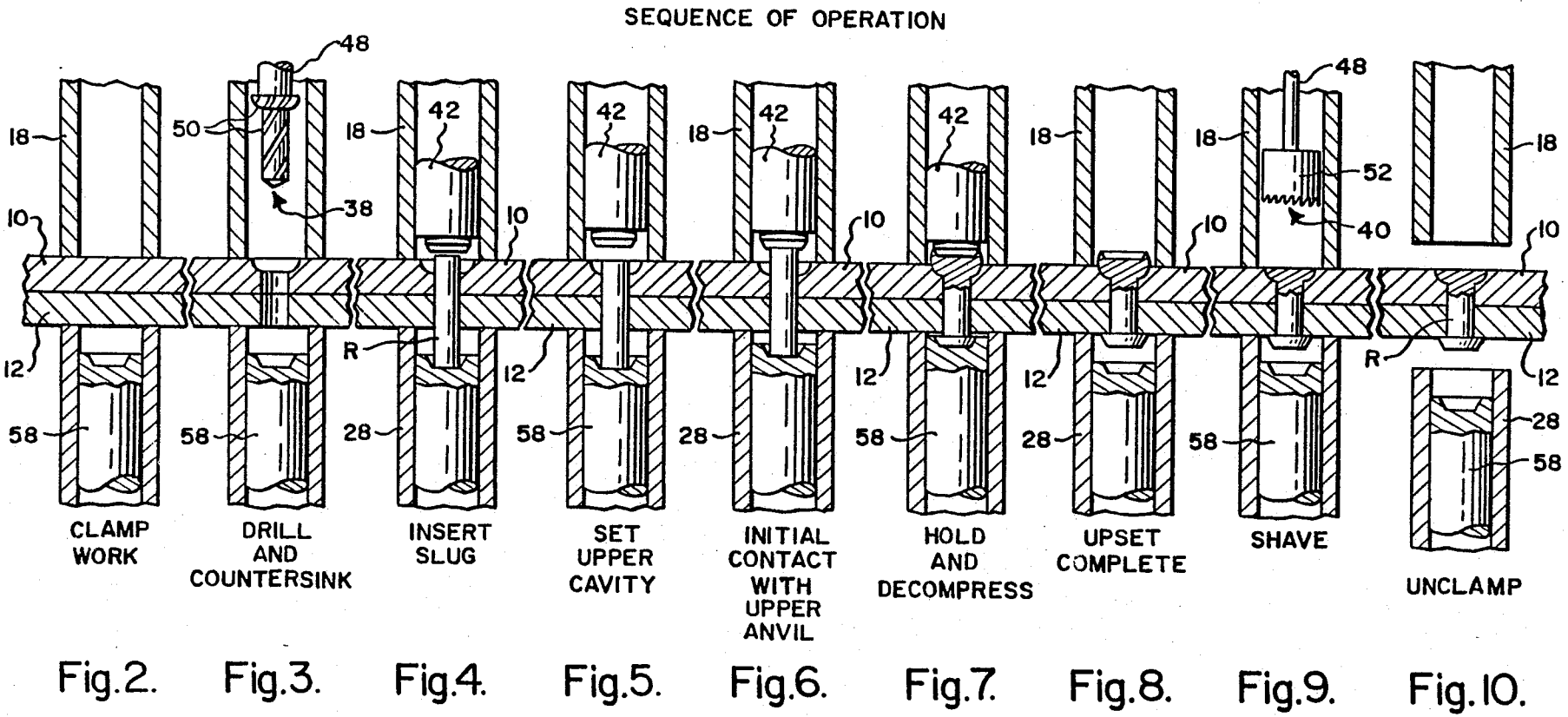
FIGS. 2 through 10 illustrate the sequence of operational steps utilized in the performance of the method of this invention.

An indexable subframe 34 is slideably supported by a portion 36 of the main frame 14, the indexable subframe supporting drilling means 38, and milling means 40 (not shown in FIG. 1), and a first riveting ram 42. The indexable subframe 34 can be indexed by any conventional mechanism as for example a stepping motor and shaft assembly partially illustrated at 44. It can be seen that as the subframe is indexed to its full right hand position as shown in FIG. 1 the drilling means may be placed in an operative position where it is coaxial with the first and second clamp means 18, 28. When the subframe is indexed to an intermediate position the first riveting ram mens 42 will be moved from an inoperative position to an operative position wherein it is coaxial with the first and second clamp means 18, 28, and in the meantime the drilling means will be shifted from an operative position to an inoperative position. While the milling means is not shown in FIG. 1, it could be positioned on the right hand side of the indexable subframe and further indexing of the subframe would move the milling means from an inoperative position to an operative position where it is also coaxial with clamp means 18, 28. Each of the drilling means and milling means would include a motor 46, a rotatable arbor shaft 48 to which a suitable tool is secured and means to shift the tool vertically. Thus, the drilling means would include a combined countersink and drill bit 50 (FIG. 3) in addition to the motor 46, arbor shaft 48 and vertical shifting means. Similarly, the milling means would include a surface milling cutter 52 (FIG. 9).

The first riveting ram means 42 is supported by a first ram piston 54 which is in turn disposed within a double acting first ram cylinder 56 supported by the indexable subframe 34. When the first riveting ram means 42 is in its operative position as shown in FIG. 1 it is coaxial with a second riveting ram means 58 disposed to the other side of the workpieces 10, 12. The second riveting ram means 58 is moveable within the second clamp means 28 and is carried by one end of the second clamp piston 32. The second clamp piston 32 is in turn interconnected with a second ram piston 60 by piston rod 62, the second ram piston in turn being disposed within double acting second ram cylinder 64. The second ram cylinder 64 is in turn rigidly interconnected with the frame 14. In order to provide for stability the cylinder 64 is double-ended, that is to say not only does piston rod 62 extend out of the upper end as shown in FIG. 1, but a lower portion 66 of piston rod 62 extends of the lower end of cylinder 64. Alternate stabilizing methods include dual pistons, where (2) pistons are used within the same cylinder housing, and external guides which support the cylinder rod in its extended position. and Similarly, the first ram cylinder 56 is also double ended, a piston rod 68 extending out of the upper end as viewed in FIG. 1. The ram 42 and piston rod 68 are in fact formed of a single rod, with the piston 54 being mounted between the ends of the rod.

Stop means indicated generally at 70 are provided which can be contacted by the upper end of the piston rod 68. The stop means includes a double acting air cylinder 72 which carries an outwardly extending piston rod 74 which may act as a stop when in its extended position as shown in FIG. 1, the piston rod in turn being secured to a piston 76 within the air cylinder 72. The stop means is in turn mounted for adjustable movement towards and away from the piston rod 68 by means of a stepping motor assembly 78 one end of which may be rigidly interconnected with the main frame 14. Alternatively, the stepping motor may be mounted on the indexable subframe 34.

The apparatus of this invention further includes force applying means capable of simultaneously moving the rams 42 and 58 together, which force applying means includes a master piston and cylinder assembly including piston 80 and single acting cylinder 82 which is rigidly interconnected with the main frame 14. Rigidly supported upon an outwardly extending portion of the master piston is a cross member 84 to which are secured first and second fluid displacement rams 86, 88, respectively. Each of these rams extend into associated first and second fluid displacement cylinders 90, 92, respectively. These cylinders are in turn rigidly interconnected with the main frame 14. It should be noted that the effective square area of the fluid displacement rams 86, 88 are proportionate to the effective square areas of the first and second ram pistons 54, 60, respectively. The cylinders 90, 92 are in turn interconnected with cylinders 56 and 64, respectively by suitable fluid lines 94, 96, respectively. Prefill check valve assembly 98, 100 are interconnected with lines 94, 96, respectively each prefill valve assembly including a line that extends to the bottom of a reservoir 102. The reservoir is part of the source of fluid under pressure which is utilized to operate the various cylinder assemblies, the source of fluid pressure including, in addition to the reservoir 102, a pump 104, filter 106 and a main fluid pressure supply line 108. The source of fluid under pressure may be mounted on the frame 14, or may be carried separately and interconnected with the various components by flexible fluid lines.

The apparatus further includes primary control means 110 which are interconnected with various valves and feedback mechanisms which will be described in conjunction with the detailed operation.

OPERATION

The apparatus is properly positioned by moving the apparatus with respect to the workpieces 10, 12 which are to be joined together. In order to insure proper operation it is necessary that the lower surface of the first clamp means be parallel to the work plane 20 and spaced away from the work plane a distance equal to the travel of the first clamp means when shifted from its initial raised position to its operative lower position (step 1) wherein it just contacts the top surface 16 of the top workpiece 10. Prior to the commencement of operation all fluid control valves are in their blocking positions with the exception of air cylinder control valve which is in that position which retracts the stop 74, first clamp cylinder control valve 114 which is in that position which causes the first clamp means or pressure foot bushing 18 to be moved to its raised position, and master cylinder control valve 116 which causes the fluid line to the master cylinder 82 to be open to reservoir 102. The initial operating position is not shown in the various figures of this application. In addition, the apparatus shown in FIG. 1 is shown in that position which it occupies at the completion of step 10 set forth below.

After positioning the apparatus with respect to the workpieces, the steps set forth then take place. For the convenience of the reader, the following Table I sets forth the position of each of the control and dump valves at the completion of each of the following steps:

1. At the commencement of operation the first clamp means 18 is moved all the way down by causing the pistons 24 to bottom out in their respective cylinders 26 by operation of first clamp cylinder control valve 114 which is switched to a position to extend piston rods 22 by operation of the primary control 110. The apparatus is so designed that the first clamp means 18 will then establish the work plane 20 for subsequent operations.

2. When the first clamp means 18 contacts limit switch 120, the primary control means 110 will cause the second clamp means or clamp bushing 28 to be moved upwardly until it contacts the side 122 of the workpiece 12. This operation is commenced by opening the first or upper second ram dump valve 124 to reservoir and simultaneously shifting the second ram cylinder control valve 126 to its "raise piston" position which will cause piston 60, piston 32 and cylinder 30 to commence upward movement. Continued upward movement of the second clamp means 28 will continue until workpieces 10 and 12 become tightly sandwiched between the first and second clamp means 18, 28, respectively. However, the second clamp piston 32 is continued to be moved upwardly after clamping is achieved, and fluid trapped within second clamp cylinder 30 is forced out through a pressure control valve 128 which holds the fluid within cylinder 30 at a constant pressure. This maintains a constant force between the first and second clamp means 18, 28.

3. Step 2 will be completed when the clamp signal device 130 is actuated which will send a signal to the primary control 110 which will in turn command valves 124 and 126 to shift to their blocking positions, thereby locking piston 60 in place within cylinder 64. The clamp signal device 130 is a proximity switch sensor which senses differential movement between the second clamp cylinder 30 and the second clamp piston 32. The sensor 130 is adjustable during initial machine set up to account for physical differences between machines. The completion of the clamping step is illustrated in FIG. 2.

4. Aligned apertures are then drilled through the workpieces 10 and 12. At the same time a countersink is produced in workpiece 10 to a pre-set depth. The drill 50 for the above is carried by the subframe 34 which also supports the first ram cylinder 56. Thus, the subframe 34 is suitably indexed to its proper location for the drilling operation. A slug rivet R is inserted into the cavity below the first riveting ram 42 while the drilling operation takes place in accordance with the method and apparatus disclosed in copending U.S patent application Ser. No. 947,850, the subject matter of which is incorporated herein by reference thereto. The drilling step is illustrated in FIG. 3. At completion of the drilling step the drill bit 50 will be retracted so that it is above the top of the first clamp means 18.

5. The subframe 34 which carries the drilling apparatus is then indexed to another position to place the first riveting ram 42 in an operative position wherein it is aligned with the apertures in workpieces 10, 12. First ram cylinder control valve 132 and the first or lower first ram cylinder dump valve 134 will then be caused to be operated by the primary control 110, valve 132 being shifted to a position to cause the first riveting ram 42 to be moved downwardly and valve 134 being opened to permit discharge of fluid to reservoir. This operation will force the slug rivet into aligned apertures which were drilled in step 4, the tail of the rivet being freely contained by the cavity between the anvil 136 on the end of the second rivet ram means 58 and the adjacent structures.

6. A ram proximity switch 138 will sense when the first riveting ram 42 has moved downwardly to a fully lowered or bottomed out position where the lower end of the anvil 140 carried by the lower end of the ram 42 is disposed a fixed distance above the work line, for example 0.015 inches. The primary control will then cause valves 132 and 134 to shift to their blocking positions. The completion of this step is illustrated in FIG. 4. The anvils 136 and 140 (which may include separable die buttons) are so selected that there will be equal metal displacement at each end of the rivet during the upsetting operation set forth in step 12 below. In other words, the anvils 136 and 140 must be properly paired for equal metal displacement.

7. The stop 74 is now extended by causing the valve 112 to shift to its other position. In order to properly establish the upper cavity, which is necessary to insure that the rivet is properly formed, the stop must be in the proper vertical position. The vertical position of the stop is adjusted via a stepping motor and output drive 78 by the primary control 110 to programmed dimensions selectable from the operator's station, the step cylinder 72 being interconnected with the stepping motor output drive. The operator does this initially to establish the required upper cavity, the particular location of the stop being determined by the thickness of the workpieces and the length and diameter of the slug rivet R.

8. Next the valve 132 will be operated to raise the ram 42 and piston rod 68 to the stop 74 to set the upper cavity, a second or upper first ram cylinder dump valve 142 also being shifted to its open position to permit discharge of fluid from the upper end of the cylinder 56 during this step. The completion of this step is illustrated in FIG. 5. When the upper end of piston rod 68 contacts the stop 74 the upper cavity will be properly set.

9. After the rod 68 contacts the stop 74 the second rivet ram 58 is caused to be raised by operation of valve 126 and valve 124 which cause the rivet to be lifted towards the upper anvil, valve 126 being shifted to its position which causes the piston 60 to be moved towards the workpieces 10, 12, and valve 124 being shifted to that position which permits fluid from the upper end of the second ram cylinder (as viewed in FIG. 1) to be dumped to reservoir.

10. The foregoing step will be completed when a load cell 144, which is mounted between the second rivet ram 58 and the second clamp piston 32, senses contact of the rivet R with the anvil 140. When contact is sensed a signal will be transmitted through a feedback line 146 to the primary control 110 which will then cause valves 124, 126, 132 and 142 to be shifted to their blocking positions. The completion of this step is illustrated in FIG. 6, as well as in FIG. 1.

11. The primary control means 110 will now cause the master cylinder and piston assembly 80, 82 to be operated to form the rivet R. It should be noted that at this time the upper chamber of the cylinder 64 is being vented to reservoir through dump valve 124. Initially the dump valve 134 will be shifted to its open position to permit the lower chamber of cylinder 56 to be vented to reservoir.

12. After dump valve 134 has been opened, the master cylinder control valve 116 will be shifted to a position wherein fluid is directed into the master cylinder 82 through line 118. As the master piston 80 is extended, ganged displacement rams 86, 88 will be forced into displacement cylinders 90 and 92, respectively, which will in turn cause fluid to be discharged from the cylinders 90 and 92. The cylinders 90 and 92 are so sized that the volumes of oil which are displaced from the cylinders will cause equal and simultaneous movement of pistons 60 and 54 towards each other to cause anvils 136 and 140 to move towards each other at equal rates to simultaneously form upset heads on both ends of the rivet R while the surface 16 of workpiece 10 continues to be maintained in the work plane 20. Test results indicate that movement of the surface 16 with respect to workline 20 is held to less than 0.005 inches during this step. At the same time the anvils are upsetting both ends of the slug rivet the valve 112 will be shifted to its other position to cause the stop 74 to be retracted. The completion of this step, which occurs when the riveting ram 42 has moved down to its bottomed out position, is sensed by the lower ram load cell 144 reaching a predetermined force setting, which, in turn, triggers an adjustable dwell time within the primary control means 110. The predetermined force setting is just slighly less than actual peak force and is set to indicate the force setting desired momentarily before top ram 42 bottoms out. In the event that the predetermined force setting is not achieved, the operator must override the controls. The bottoming out of ram 42 will stop further movement of the slave cylinders.

13. When the dwell time is completed, the valve 116 will then be shifted to a decompression or blocking position and the operation of a decompression timer will be initiated.

14. When the decompression timer times out, valve 116 will be shifted to a squeeze retract or open to reservoir position and will remain there until the next machine cycle. Valves 124 and 136 will also be shifted to their closed position. The completion of this step is illustrated in FIG. 7.

15. The second rivet ram means 58 is now commanded to retract to a backaway position by momentarily opening the second or lower second ram cylinder dump valve 148 to reservoir and shifting valve 126 to that position which will cause piston 60 to move away from the workpieces 10, 12.

16. At the completion of step 15, the valves 126 and 148 are shifted back to their blocking positions.

17. Valve 132 is now commanded by the primary control 110 to be shifted to a position which causes the first riveting ram 42 to be moved away from the workpieces and valve 142 is also shifted to its open position. Because of the restriction 150 in the line from the first ram cylinder 56 to dump valve 142, most of the oil being displaced from the cylinder 56 is forced through the line 94 leading to displacement cylinder 90. The oil flowing into cylinder 90 forces ram 86 out of the cylinder which in turn causes the master cylinder piston 80 of the master cylinder 82 to retract to its home position. During this action, the ram 88 in cylinder 92 is being pulled outwardly of cylinder 92 and causes oil to be sucked into the cylinder from the tank through the prefill valve 100. Oil displaced from master cylinder 82 will flow to reservoir 102 through valve 116.

18. When the first riveting ram 42 is fully retracted, which is sensed by limit switch 152 being contacted by rod 68, dump valve 142 will be shifted back to its closed position, and valve 132 will be shifted to its locking position. The completion of this step is illustrated in FIG. 8.

19. Now, optionally, the subframe 34 which carries the cylinder 56 will be indexed to a further position and a milling cutter will be brought into contact with upper surface of the deformed slug and will shave it to within 0.002 of an inch of the surface 16. The milling cutter will then retract after the completion of this operation and the indexable subframe 34 will return to its drill position. The shaving step is illustrated in FIG. 9.

20. Dump valve 148 will now be commanded to open by the primary control means 110 and valve 126 will also be commanded to shift to cause oil to be delivered to the top of the cylinder 64. As fluid flows into the top of the cylinder 64 the piston 60 will be caused to be moved downwardly carrying with it piston 32, cylinder 30 and the second clamp means 28. As there is constant pressure on cylinder 30 at all times, due to its connection with the pressure control valve 128, it will extend during this time until its inwardly extending flange 154 contacts the stop surface 156 on piston 32. The second clamp means 28 will now disengage from the lower surface 122 of the workpiece 12 and travel down with the second rivet ram means 58 until its desired position is sensed by an adjustable proximity switch 158.

21. When the desired lower position is achieved the primary control 110 will now command valves 126 and 148 to return to their blocking positions. Upon completion of the head transfer back to the drill position a command will be issued to shift valve 114 to its other position to cause the first clamp means 18 to raise from the workpiece 10. The completion of this step is illustrated in FIG. 10. As the workpiece is now unclamped, the entire apparatus may be moved relative to the workpieces 10, 12 to the next rivet position.

While a preferred structure in which the principles of the present invention have been incorporated is shown and described above, it is to be understood that widely differing means may be employed in the broader aspects of this invention. Accordingly, this invention is intended to embrace all such alternatives, modifications, and variations which fall within the spirit and scope of the appended claims.

What is claimed is:

1. Method of riveting two or more side-by-side workpieces together, the workpieces being provided with aligned apertures in which a slug rivet has been received, one side of one workpiece establishing a substantially fixed work plane; said method comprising the following steps:

providing first and second riveting ram means aligned with the slug rivet, the first riveting ram means being disposed adjacent said one side of said one workpiece, and the second riveting ram being disposed away from the outer side of another workpiece;

moving the first riveting ram means with respect to the work plane to establish a first desired die cavity;

moving the second riveting ram means towards the first riveting ram means until both ends of the slug rivet are just in contact with both riveting ram means; and simultaneously moving the first and second riveting ram means towards each other at equal rates to simultaneously form upset heads on both ends of the slug rivet while said one side of the one workpiece continues to be disposed in the work plane.

2. The method as set forth in claim 1 wherein the simultaneous moving of the first and second riveting ram means is accomplished by the application of fluid pressure, the pressure being applied for a dwell time after a pre-determined force is sensed when the heads on both ends of the rivet are substantially fully upset.

3. The method as set forth in claim 2 wherein the source of fluid pressure to the first and second riveting ram means is blocked during a decompression period of time.

4. The method of riveting as set forth in claim 3 wherein the fluid pressure is dumped at the completion of the preceding step, and wherein the first and second riveting ram means are moved away from each other after the fluid pressure is dumped.

5. The method of riveting as set forth in claim 1 wherein the first and second riveting ram means are moved away from each other after the upset heads on both ends of the rivet are fully formed, and further characterized by the step of milling the upset head on one end of the rivet which lies adjacent said one side of said one workpiece so that after milling the milled surface of the rivet lies very close to said one side of said one workpiece.

6. A method of riveting two or more side-by-side workpieces together comprising the following steps:

providing first and second clamp means and first and second riveting ram means aligned with each other, the first clamp means and first riveting ram means being disposed to one side of one of the workpieces and the second clamp means and second riveting ram means being disposed away from the outer side of another workpiece;

moving the first clamp means into contact with said one side of said one workpiece to establish a fixed work plane;

moving the second clamp means towards the first clamp means to clamp the workpieces between the first and second clamp means with a constant force with said one side of said one workpiece being maintained in said fixed work plane;

positioning a rivet within aligned apertures in the workpieces, the aligned apertures being in alignment with the first and second riveting ram means;

contacting both ends of the slug rivet with the first and second riveting ram means;

simultaneously moving the first and second riveting ram means towards each other to apply equal rates to simultaneously form upset heads on both ends of the rivet while the first and second clamp means said one side of said one workpiece in the fixed work plane;

moving the first and second riveting ram means away from each other after the upset heads on both ends of the rivet have been formed; and subsequently moving the first and second clamp means away from each other to unclamp the workpieces.

7. The method set forth in claim 6 further characterized by the step of moving the first riveting ram means with respect to the fixed work plane to establish a first desired die cavity, and wherein both ends of the rivet are contacted by the first and second riveting ram means by moving the second riveting ram means towards the first riveting ram means after the first desired die cavity has been established until both ends of the slug rivet are just in contact with both riveting ram means.

8. The method as set forth in claim 6 wherein drilling means are provided, and further characterized by the step of drilling aligned apertures through the workpieces after the workpieces have been clamped together and prior to the step of positioning the rivet within the aperture.

9. The method of riveting as set forth in claim 6 wherein milling means are provided, and further characterized by the step of milling the upset head on that end of the rivet which lies adjacent said one side of said one workpiece immediately prior to the unclamping step.

10. A method of riveting two or more side by side workpieces together comprising the following steps:

providing first and second opposed clamp means, first and second riveting ram means, drilling means, and an indexable subframe being disposed to one side of one of the workpieces, and the second clamp means and second riveting ram means being disposed away from to the other side of another workpiece, the first riveting ram means and the drilling means being mounted on the subframe;

moving the first clamping means downwardly into contact with said one side of said one workpiece to establish a substantially fixed work plane;

moving the second clamp means towards the first clamp means to clamp the workpieces together with a constant force with said one side of said one workpiece being maintained in said substantially fixed work plane;

moving the indexable subframe to a first position to position the drilling means in an operative position and the first riveting ram means in an inoperative position;

drilling aligned apertures through the workpieces;

moving the indexable subframe to a second position to position the drilling means in an inoperative position and the first riveting ram means in an operative position in alignment with the aligned apertures and the second riveting ram means, placing a slug rivet within the aligned apertures, moving the first riveting ram means with respect to the substantially fixed work plane to establish a first desired die cavity;

moving the second riveting ram means towards the first riveting ram means until both ends of the slug rivet are just in contact with both riveting ram means;

simultaneously moving the first and second riveting ram means towards each other at equal rates to simultaneously form upset heads on both ends of the rivet while the clamp means maintains said one side of said one workpiece in the substantially fixed work plane;

maintaining the ends of the first and second riveting ram means in contact with the upset heads for a predetermined period of time;

moving the first and second riveting ram means away from each other after the upset heads on both ends of the rivet has been properly formed; and subsequently moving the first and second clamp means away from each other to unclamp the workpieces.

11. Apparatus for riveting two or more side-by-side workpieces together, the workpieces being provided with aligned apertures in which a slug rivet has been received, one side of one workpiece establishing a substantially fixed work plane; said apparatus comprising:

first and second riveting ram means aligned with the rivet, the first riveting ram means being disposed adjacent said one side of said one workpiece, and the second riveting ram means being disposed away from the outer side of another workpiece;

first moving means capable of moving the first riveting ram means with respect to the work plane to establish a first desired die cavity;

second moving means capable of moving the second riveting ram means towards the first riveting ram means until both ends of the rivet are just in contact with both riveting ram means; and force applying means capable of simultaneously moving the first and second riveting ram means towards each other at equal rates to simultaneously form upset heads on both ends of the rivet while said one side of said one workpiece continues to be disposed in the work plane.

12. The apparatus for riveting as set forth in claim 11 wherein the first and second riveting ram means are supported by first and second ram pistons within first and second ram cylinders, respectively, and wherein the force applying means capable of simultaneously moving the first and second riveting ram means towards each other includes means for introducing fluid into each ram cylinder to displace the first and second ram pistons towards each other, the volume of the fluid being introduced into each ram cylinder being proportionate to the effective area of each ram piston whereby the first and second ram pistons will be moved towards each other at the same rate.

13. The apparatus for riveting as set forth in claim 12 wherein the force applying means further includes first and second commonly mounted fluid displacement rams which are moved into associated fixed first and second displacement cylinders from which fluid is displaced under pressure, the effective square area of the first and second fluid displacement rams being proportionate to the effective square areas of the first and second ram pistons, respectively.

14. The apparatus for riveting as set forth in claim 13 wherein the force applying means includes a further master piston and cylinder assembly which is coupled to the two commonly mounted fluid displacement rams.

15. The apparatus for riveting as set forth in claim 11 further characterized by the provision of stop means capable of stopping movement of the first riveting ram means, the first riveting ram means being moved against said stop means by the means for moving the first riveting ram means whereby the first desired die cavity is established.

16. The apparatus for riveting as set forth in claim 11 wherein one of said first and second riveting ram means are so designed that there will be equal metal displacement at each end of the rivet when both ends of the rivet are simultaneously upset.

17. The apparatus for riveting as set forth in claim 11 further characterized by the provision of means to move the first and second riveting ram means away from each other after the upset heads on both ends of the rivet have been formed.

18. An apparatus for riveting two or more side-by-side workpieces together comprising the following:

first and second clamp means, one clamp means being disposed to one side of the workpieces and the second clamp means being disposed to the outer side of another workpiece;

first and second riveting ram means, the first riveting ram means being disposed to said one side of said one workpiece, and the second riveting ram means being disposed away from the outer side of another workpiece;

means for moving the first clamp means capable of moving the first clamp means into contact with said one side of said one workpiece to establish a fixed work plane;

means for moving the second clamp means capable of moving the second clamp means towards the first clamp means to clamp the workpieces between the first and second clamp means with a constant force with said one side of the workpieces being maintained in said fixed work plane;

rivet positioning means capable of positioning a slug rivet within aligned apertures in the workpieces, the aligned apertures being in alignment with the first and second riveting ram means;

means to move the first riveting ram means capable of moving the first riveting ram means with respect to the fixed work plane to establish a first desired die cavity;

means to move the second riveting ram means capable of moving the second riveting ram means towards the first riveting ram means until both ends of the rivet are just in contact with both riveting ram means;

force applying means capable of simultaneously moving the first and second riveting ram means towards each other at equal rates to simultaneously form upset heads on both ends of the rivet while the first and second clamp means maintain said one side of said one workpiece in the fixed work plane;

means capable of moving the first and second riveting ram means away from each other after the upset heads on both ends of the rivet have been formed; and means capable of subsequently moving the first and second clamp means away from each other to unclamp the workpieces.

19. The apparatus as set forth in claim 18 wherein the apparatus further includes an indexable subframe mounted to said one side of the workpieces, the first riveting ram means being mounted on said subframe for movement between operative and inoperative positions, and further characterized by the provision of drilling means mounted on said subframe for movement between operative and inoperative positions, the drilling means being capable of drilling aligned apertures through the workpieces when the drilling means is in its operative position and after the workpieces have been clamped together.

20. The apparatus for riveting as set forth in claim 18 further characterized by the provision of milling means capable of milling the upset head on that end of the rivet which lies adjacent said one side of said one workpiece.

21. The apparatus of riveting as set forth in claim 20 wherein said milling means is carried by said indexable subframe for movement between operative and inoperative positions.

22. An apparatus for riveting two or more side-by-side workpieces together comprising the following:

first and second opposed clamp means, one clamp means being disposed to one side of one of the workpieces and the second clamp means being disposed away from an outer side of another workpiece;

an indexable subframe mounted to said one side of said one workpiece;

drilling means mounted on said subframe for movement between operative and inoperative positions, the drilling means being capable of drilling aligned apertures through the workpieces when in its operative position;

first and second riveting ram means, the first riveting ram means being mounted on said subframe for movement between operative and inoperative positions, and the second riveting ram means being disposed away from the outer side of said another workpiece;

means for moving the first clamp means capable of moving the first clamp means into contact with said one side of said one workpiece to establish a fixed work plane;

means for moving the second clamp means capable of moving the second clamp means towards the first clamp means to clamp the workpieces between the first and second clamp means with a constant force with said one side of said one workpiece being maintained in said fixed work plane;

rivet positioning means capable of positioning a slug rivet within aligned apertures in the workpieces, the aligned apertures being in alignment with the first and second riveting ram means;

means to move the first riveting ram means capable of moving the first riveting ram means with respect to the fixed work plane when the first riveting ram means is in its operative position to establish a first desired die cavity;

means to move the second riveting ram means capable of moving the second riveting ram means towards the first riveting ram means until both ends of the rivet are just in contact with both riveting ram means;

force applying means capable of simultaneously moving the first and second riveting ram means towards each other at equal rates to simultaneously form upset heads on both ends of the rivet while the clamp means maintains said one side of said one workpiece in the fixed work plane;

means capable of moving the first and second riveting ram means away from each other after the upset heads on both ends of the rivet have been formed; and means for subsequently moving the first and second clamp means away from each other to unclamp the workpieces.

* * * * *

UNITED STATES PATENT AND TRADEMARK OFFICE

CERTIFICATE OF CORRECTION

PATENT NO. : 4,908,928

DATED : March 20, 1990

INVENTOR(S) : Frank T. Mazurik et al

It is certified that error appears in the above-identified patent and that said Letters Patent is hereby corrected as shown below:

Column 9, claim 6, line 28, after "means" insert --maintain--.

Signed and Sealed this

Twenty-eighth Day of January, 1992

*Attest:*

HARRY F. MANBECK, JR.

*Attesting Officer*

*Commissioner of Patents and Trademarks*